United States Patent [19]

Ahlgren et al.

[11] Patent Number: 4,839,559

[45] Date of Patent: Jun. 13, 1989

[54] RADIANT ENERGY INCANDESCENT LAMP

[75] Inventors: Frederic F. Ahlgren, Shaker Heights; Rolf S. Bergman, Cleveland Heights; John M. Davenport, Lyndhurst; Richard L. Hansler, Pepper Pike; Robert G. Hantman, Chagrin Falls; Leonard E. Hoegler, Solon, all of Ohio

[73] Assignee: General Electric Company, Schenectady, N.Y.

[21] Appl. No.: 158,509

[22] Filed: Feb. 22, 1988

[51] Int. Cl.[4] ..... H01K 1/24; H01K 1/50; H01K 3/06; H01K 3/12

[52] U.S. Cl. ..... 313/579; 313/279; 445/27; 445/32

[58] Field of Search ..... 313/279, 579; 445/32, 445/27

[56] References Cited

U.S. PATENT DOCUMENTS

| | | | |
|---|---|---|---|
| 2,945,978 | 7/1960 | Hodge | 313/279 |
| 3,117,363 | 1/1964 | Brady et al. | 445/32 |
| 3,538,374 | 11/1970 | Kane | 313/279 X |
| 3,675,070 | 7/1972 | Prytkov | 313/279 |
| 3,940,650 | 2/1976 | Janssen | 313/279 X |
| 4,509,928 | 4/1985 | Morris et al. | 445/27 |
| 4,588,923 | 5/1986 | Hoegler et al. | 313/579 |

FOREIGN PATENT DOCUMENTS

| | | | |
|---|---|---|---|
| 648360 | 9/1962 | Canada | 313/279 |

*Primary Examiner*—Palmer C. DeMeo

*Attorney, Agent, or Firm*—John P. McMahon; Stanley C. Corwin; Fred Jacob

[57] ABSTRACT

An electric incandescent lamp for selective radiant energy distribution is disclosed which employs a reflective film for improved efficiency of the lamp operation. Said lamp further employs a tungsten filament extending the length of its elongated lamp envelope with particular support means for said incandescent filament also being disclosed to precisely position the filament along the principal lamp axis. Various structural configurations for said particular support means are also disclosed so that such filament position is maintained regardless of the lamp spatial orientation.

2 Claims, 1 Drawing Sheet

RADIANT ENERGY INCANDESCENT LAMP

BACKGROUND OF THE INVENTION

This invention relates to electric incandescent lamps of the type which provide radiant energy efficiently and more particularly to a structural configuration for this type lamp to improve its operating efficiency.

One type electric incandescent lamp for general illumination employs a refractory metal filament as the light source. Said light source is commonly supported within a hermetically sealed lamp glass envelope by wire inleads with the filament orientation being either horizontal or vertical with respect to the principal lamp axis. Adequate physical support for the incandescent filament in said type lamp is generally provided by connecting the lamp inleads to both ends of the filament although it is known to provide additional intermediate support along the length of said filament.

Lamps of the same general type are also known emitting selectively in both the infrared and visible spectral regions with such lamps providing studio lighting having a daylight color. A representative structural configuration for lamps of this type is disclosed in U.S. Pat. No. 4,588,923, assigned to the assignee of the present invention, and wherein the selective radiant energy distribution from the lamp is achieved with a reflective film deposited on the lamp envelope. As can be noted from the description appearing in said commonly assigned prior art patent, the optical pass-band and the stop-band characteristics selected for said reflective film medium serve to reflect infrared radiation back to the lamp filament. The filament operating efficiency can be increased in this manner for more efficient light output from the lamp since the reflective film is selected so as to still transmit a major portion of the desired visible radiation. The above mentioned patent is specifically incorporated herein by reference, due to the same reflective film characteristics being employed in the present lamp improvement.

For infrared reflective coatings on such type incandescent lamps to be effective it is essential for the reflected energy to be focused back upon the lamp filament. For this optical criteria to be satisfied, it becomes understandably further necessary that the lamp filament be precisely located with respect to the reflective film deposited on the lamp envelope. Now employed filament support means in lamps of this type do not maintain accurate filament orientation in a number of respects. Said now employed filament support means consists of wire loops enveloping the tungsten coil exterior and exerting a spring pressure against the inner wall of the lamp envelope. Understandably, such flexible support means is not only subject to movement during lamp operation along all of the lamp axes but itself requires physical support by the lamp filament if the lamp is burned in a vertical spatial orientation. Moreover, filament support means of this type cannot easily be introduced into the elongated lamp envelope during lamp manufacture and with disengagement or misalignment frequently occurring at this time between such spiral supports and filament coils.

Accordingly, it is a principal object of the invention to provide more reliable filament support means in an electric incandescent lamp emitting selective radiant energy distribution in order to maintain the filament position more precisely along the principal lamp axis.

It is another important object of the present invention to provide a more effective physical engagement between the filament member and the filament support means in said type electric incandescent lamps.

Still another important object of the present invention is to provide structural means whereby the presently improved filament support means can be further secured in place with respect to the lamp envelope wall.

A still further important object of the present invention is to provide improvement filament support means in said type electric incandescent lamp enabling still more reliable lamp manufacture, particularly with high speed automated lamp manufacturing equipment.

These and other objects of the present invention will become more apparent upon consideration of the following description for the present invention.

SUMMARY OF THE INVENTION

Improved filament support means are provided according to the present invention in an electric incandescent lamp for selective radiant energy distribution whereby a major portion of the desired visible radiation being derived from the lamp filament is transmitted outwardly from the lamp envelope while a major portion of the infrared radiation being emitted by said filament is reflected backwardly toward said filament. Said particular lamp construction generally utilizes a radiation transmissive elongated lamp envelope having a coiled refractory metal filament aligned accurately along the principal lamp axis for emission in both visible and infrared spectral regions with a reflective film being deposited on the surface of said lamp envelope. As disclosed in the aforementioned prior art patent, this reflective film is capable of operating at a temperature in the range up to and including 950° C. with said film being formed of a plurality of layers exhibiting high and low optical refractive indices of refractory materials effective to establish a pass-band characteristic and a stop-band characteristic providing the selective radiant energy distribution above specified. The coiled refractory metal filament in said lamp extends the axial length of the lamp envelope while being mechanically and electrically connected at both ends to inlead conductors hermetically sealed at the envelope ends while the presently improved filament support means maintains said filament centered within said envelope and is located intermediate the length of said filament. The present filament support means comprises a refractory metal body enclosed within the central cavity of said coiled refractory metal filament which further includes at least one integral projection extending outwardly between the coil turns of said filament and physically engaging the inner walls of the lamp envelope.

In one preferred embodiment, the filament support member consists of a ball-shaped tungsten spud formed in the central region of the short tungsten wire length with both wire ends left to extend outwardly from said central body region. The central body portion of said tungsten body is shaped and sized to fit within the central cavity of the lamp filament coil so as to enable assembly of this support member to the filament coil by simply stretching the filament coil turns apart. Relaxation of the filament coil completes such assembly with both projections of the support members extending outwardly from opposite sides of the filament coil to engage the inner wall of the lamp envelope in the final lamp assembly. It can be appreciated that providing such support means for the filament coil precludes any physical displacement between the assembled lamp components to better maintain the filament in a fixed central location within the lamp envelope. While a simple placement of such filament assembly within a cylindrically shaped tubular lamp envelope can still permit some linear filament expansion and contraction along the principal lamp axis during lamp operation such movement still retains an accurate central filament position within the lamp envelope. In a preferred method of manufacture for such lamp construction, a pre-assembly of the support member and lamp filament coil is first effected as above specified and said pre-assembly thereafter inserted into one end of the cylindrical lamp envelope tube. Lamp inlead can then be secured to both ends of the lamp filament coil and a fill of inert gas containing a relatively small quantity of halogen gas may be added to the lamp envelope all in an otherwise conventional lamp manufacturing manner. Hermetically sealing both ends of the lamp envelope at the inlead conductor locations completes said lamp manufacture with the filament being maintained by its support means at the center of the envelope cylinder and extending along its axial length.

In a different preferred embodiment for the presently improved filament support member, a tungsten coil is formed with smaller diameter wire than the lamp filament coil diameter and this support member is again sized in external coil diameter to fit within the central cavity of the tungsten lamp coil. Said smaller diameter support coil can be threaded along the axial length of said filament coil to its desired location intermediate the length of said filament coil and with physical engagement taking place therebetween by means of having end turns on the support coil lodged between turns of the lamp filament coil and emerging outwardly therefrom to physically contact the lamp envelope inner wall. Such threading of the support coil on the lamp filament coil better averts dislodgement between the assembled components during lamp manufacture while proper sizing in pitch and wire diameters for the respective components imparts mechanical stability in the final lamp construction. It also follows that support members of the present type can function when the projecting end extends outwardly from only one side of the lamp coil. In both type embodiments, however, further sealing engagement can be provided between the contacting support member projections and the lamp wall to increase ruggedness of the final lamp assembly and thereby better maintain a filament location on the desired central axis. On the other hand, comparable fixed engagement between a single ended support member and the lamp end wall can be provided by deforming said lamp wall at the desired location of the support member.

In a still different preferred lamp construction utilizing the present improved lamp filament support means, there is employed an ovoid shaped lamp envelope having the reflective film deposited on the exterior surface of said lamp envelope. To better establish maximum optical cooperation between said reflective film and a tungsten coil filament extending the axial length of said lamp envelope, a double-ended support member is provided with both projecting ends of said member being fused to the quartz envelope wall at a central location along the lamp axis. Understandably, such physical attachment to the lamp wall could also be provided with a ceramic sealing material, such as a suitable silicate-borate glass. The latter modification can be achieved during lamp manufacture with a pre-assembled tungsten lamp coil and double-ended tungsten support member having the protruding ends for said support member being coated with a bead of the sealed glass mixture. To further illustrate, such pre-assembly can thereafter easily be inserted into a two millimeter diameter end opening provided in a typical four millimeter inside diameter ovoid lamp envelope whereupon the flexible beaded ends of said support member spring open and physically engage the inner wall of said lamp envelope. Subsequent heating of the sealed glass beads in a conventional manner permanently secures such filament assembly to the lamp envelope wall. Additionally, it is also contemplated to provide still more accurate filament alignment along the principal lamp axis with a plurality of the present support members being spaced apart along the length of said filament.

DETAILED DESCRIPTION OF THE PREFERRED EMBODIMENTS

Figure 1:
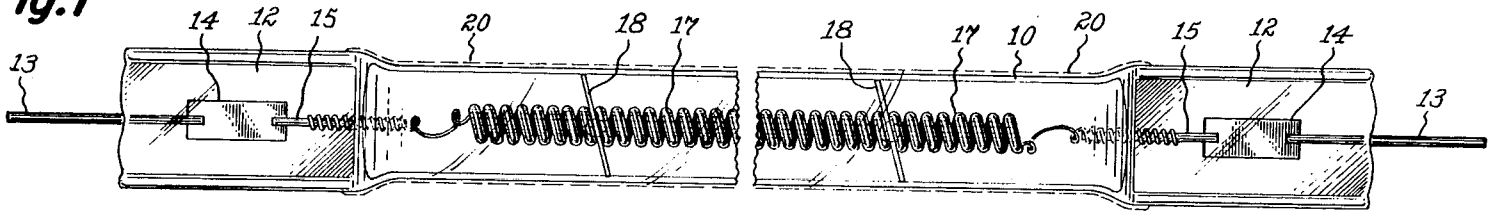
FIG. 1 is a side view depicting one lamp construction embodying the present filament support means.

Referring to the drawings a lamp is depicted in FIG. 1 employing the same general construction as disclosed in the aforementioned U.S. Pat. No. 4,588,923. Accordingly, said lamp includes a radiation transmissive envelope 10 having an elongated tubular shape and fabricated of a clear fused quartz, or translucent fused quartz, or quartz-like glass such as that known commercially as VYCOR available from the Corning Glass Works. Although the tubular envelope depicted in FIG. 1 is a double-ended type, the practice of the present invention further contemplates a single-ended type elongated lamp envelope. Typical dimensions for a suitable double-ended type quartz envelope can be $3\times5$ millimeter diameter quartz tubing having a 20 millimeter length. Each end of said lamp envelope 10 has a pinched portion 12 through which is sealed a lead-in conductor 13 connected to another lead-in conductor 15 by a thin intermediate foil portion 14 which is hermetically sealed and embedded in the pinch portion 12. The foil portion 14 may be a separate piece of molybdenum welded to one end of each of the lead-in conductors 13 and 15. Alternatively, the foil portion 14 can be an integral portion of a single length of molybdenum wire. Further, for a glass type tubular envelope 10 the lead-in conductors 13 and 15 may be a single rod-type member not having foil portion 14, for a straight through entrance into tubular envelope 10. Said lamp envelope 10 further includes a coiled coil type tungsten filament 17 extending through it in an axial manner. Said coiled filament 17 as shown more clearly in FIG. 2 consists of a multiple wound helical coil of tungsten wire having the well-known conventional configuration. A fine size tungsten wire diameter is employed for a lamp to be operated at household voltages with the coil length and pitch being further determined in a conventional manner by the rated lamp wattage, such as 90 watts for the representative lamp embodiment herein being depicted. Said lamp filament 17 is shown to be physically supported by a plurality of tungsten support members 18 having the physical configuration enabling cooperation according to the present invention. A reflective film 20 covers the outer surface of the lamp envelope 10 to provide means whereby a major portion of the visible radiation being emitted by said lamp filament 17 is transmitted outwardly from said lamp envelope 10 whereas a major portion of the infrared radiation being emitted by said lamp filament is reflected by said reflective film back toward said filament. As more fully explained in the above mentioned U.S. Pat. No. 4,588,923, said reflective film 20 exhibits the necessary pass-band and stop-band optical characteristics for such operative association with the lamp filament 17 but also making it essential for maximum benefit that said filament remain accurately centered in the lamp envelope throughout its operating lifetime.

Figure 2:
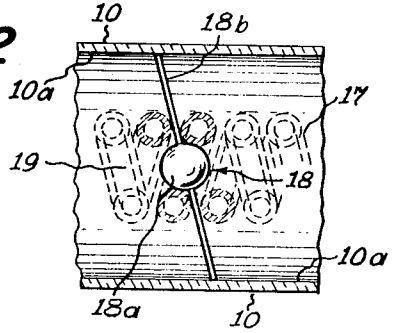
FIG. 2 provides a more detailed view of the filament support means shown in FIG. 1.

FIG. 2 depicts further construction details for one lamp support member 18 when assembled to the coiled lamp filament 17 as above illustrated in FIG. 1. Specifically, said coiled lamp filament 17 engages a ball-shaped support member 18 located within its central cavity 19 and which is physically connected to the spiral turns of said filament coil. The ball-shaped body portion **18*a* of said support member terminates at opposite ends in projections 18*b* which extend outwardly between successive turns of the lamp coil and with said projections held in place by the spring force being exerted between said adjacent filament coil turns. Both emerging terminal ends of said projections 18*b* physically engage the inner lamp envelope wall 10*a***. As hereinbefore pointed out, the depicted physical arrangement between said support member and filament coil is readily achieved with but a simple modification to the otherwise conventional lamp manufacturing process. Such modification consists of stretching the filament coil turns apart to insert the support member into the central cavity between the spaced apart coil turns and relaxing the filament coil to lock the support member in place. This pre-assembly can now be utilized in a conventional manner wherein both ends of the lamp coil are hermetically sealed in the elongated lamp envelope.

Figure 3:
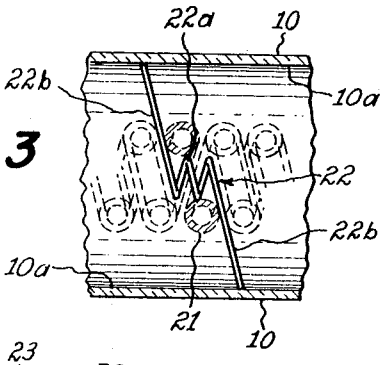
FIG. 3 depicts a detailed view of a different filament support means according to the present invention.

FIG. 3 depicts a different structural configuration for the present filament support member wherein a small coil of tungsten wire is located within the central cavity of the coiled lamp filament. Accordingly, said coiled lamp filament 21 includes a smaller diameter tungsten coil 22 which has been threaded inside the exterior coil turns of the filament coil. The center coil body portion **22*a* of said support member terminates at opposite ends in coil turns 22*b* which are again locked in place with a spring force being exerted by adjacent turns in the coiled lamp filament. As can also be seen, the emerging terminal ends of said coiled support member 22 physically engage the inner wall 10*a* of the lamp glass envelope 10**. Further sealing engagement between said terminal coil ends and the lamp envelope wall as previously indicated provides additional mechanical strength to the supported filament coil. As also hereinbefore pointed out, said depicted physical arrangement between the support member and filament coil can be provided with a simple change being made to otherwise conventional lamp manufacture. The smaller diameter support coil can first be threaded into the filament coil to form a pre-assembly suitable for insertion into the lamp envelope and hermetic sealing, all in the conventional manner. Such threaded engagement for the support member not only imparts mechanical strength but also improves manufacturing reliability since its disengagement becomes more difficult during lamp assembly operations.

Figure 4:
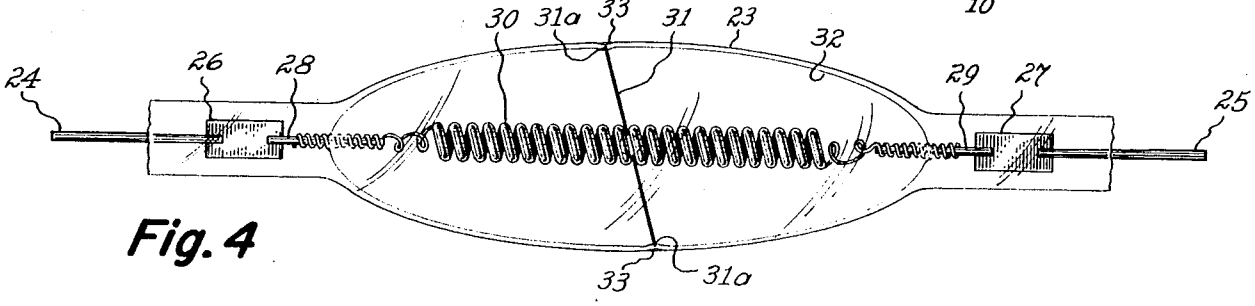
FIG. 4 is a side view for a different lamp construction embodying the present filament support means.

In FIG. 4 there is shown a different preferred lamp construction utilizing the presently improved lamp filament support means. Specifically, said lamp includes an ovoid shaped fused quartz envelope 23 of the double-ended type and with both ends of said lamp envelope employing the pinched-seal construction hereinbefore described for FIG. 1 lamp embodiment. Each lamp termination thereby features inlead connectors 24 and 25 connected to refractory metal foil elements 26 and 27, respectively, and which in turn are connected at the opposite ends to internal inlead conductors 28 and 29. Said internal inlead conductors 28 and 29 are connected to the opposite ends of a coiled tungsten filament 30 aligned along the principal lamp axis and hermetically sealed within the lamp envelope along with the same type gas fill (not shown) also described in connection with said FIG. 1 lamp embodiment. A single filament support member 31 is positioned at the mid-point of the filament coil 30, said support member optionally having a physical configuration and engagement as previously described for either FIGS. 2–3. Both terminal ends **31*a* of said support member have been fused to the inner wall 32 of said fused quartz envelope to better maintain a fixed location of the filament coil along the principal lamp axis. Such fixed support means not only resists filament movement in all directions but has been found to impart increased mechanical strength resisting lamp breakage from mishandling. Such anchoring of the support member projecting ends 31*a* to the lamp glass wall can readily be achieved by heating but which is often accompanied by a slight deformation 33 provided in the glass wall at these heating sites. Since the principal benefit being achieved with the presently improved filament support means is that of reflecting maximum infrared energy back to the filament, however, it can be appreciated that such deformations in the lamp envelope wall now reduce the desired effect. It may thereby prove advantageous to physically secure said support member projecting ends 31*a*** in the previously mentioned alternative manner with a suitable ceramic material, such as silicate-borate sealing glass.

It will be apparent from the foregoing description that a generally improved filament support means has been provided for an electric incandescent lamp imparting both operating efficiency and physical ruggedness to the lamp construction. It will be apparent that modifications can be made in the specific contour and physical features of the filament support members above described without departing from the spirit and scope of the present invention. For example, it is equally feasible to employ a support member construction having but a single integral projection and which can be anchored to the inner wall of the lamp envelope. Additionally, filament coils other than the coiled coil filament construction selected in the above specifically disclosed lamp embodiments can as readily engage the present filament support members with comparable results. The color of visible radiation being emitted from the present lamp construction can also be varied by modification of the reflective film being employed. Consequently, it is intended to limit the present invention only by the scope of the appended claims.

What we claim as new and desire to secure by Letters Patent of the United States is:

1. An electric incandescent lamp for selective radiant energy distribution which comprises:

an elongated hermetically sealed light transmissive envelope containing a filling of inert gas and a relatively small quantity of halogen gas, a coiled refractory metal filament extending the axial length of said envelope while being mechanically and electrically connected at both ends to inlead conductors hermetically sealed at said envelope ends, support means having a ball shape body portion with projections extending outwardly from the body portion, said support means maintaining said filament centered within said envelope and located intermediate the length of said filament, said support means comprising a refractory metal body enclosed within the central cavity of said coiled refractory metal filament and which includes at least one of said extending outwardly projections between the coil turns of said filament to physically engage the inner wall of said envelope, and a reflective film located on the surface of said envelope, said reflective film having a pass-band and a stop-band characteristic such that a major portion of the desired visible radiation being emitted by said filament is transmitted outwardly from said envelope whereas a major portion of the infrared radiation being emitted by said filament is reflected by said reflective film backwardly toward said filament.

2. In the manufacture of an electric incandescent lamp which comprises an elongated hermetically sealed light transmissive envelope containing a filling of inert gas and a relatively small quantity of halogen gas along with a coiled tungsten filament extending the axial length of said envelope, the steps of placing support means within the central cavity of said filament at the desired axial location intermediate the length of said filament, said support means comprising a tungsten body having the size and shape to fit said cavity and which further includes at least one projection extending outwardly between the coil turns of said filament to physically engage the inner wall of said envelope, securing the outer end of said at least one projection to the inner wall of said envelope by applying a sealing material thereto, inserting said filament assembly into said envelope, and hermetically sealing both ends of the lamp envelope at the inlead conductor locations.

* * * * *